US005887410A

United States Patent [19]

Lowenthal

[11] Patent Number: 5,887,410

[45] Date of Patent: Mar. 30, 1999

[54] METHOD OF MOLDING AN PACKAGING OF A NOVELTY SOAP

[75] Inventor: Garry Lowenthal, Falcon Heights, Minn.

[73] Assignee: International Beauty Network, Inc, Minneapolis, Minn.

[21] Appl. No.: 960,102

[22] Filed: Oct. 27, 1997

Related U.S. Application Data

[63] Continuation of Ser. No. 785,120, Jan. 21, 1997, abandoned, which is a continuation of Ser. No. 396,630, Mar. 1, 1995, abandoned.

[51] Int. Cl.[6] ..... B65B 55/14

[52] U.S. Cl. ..... 53/440; 53/445; 53/474

[58] Field of Search ..... 206/461, 463, 206/459.5, 471, 77.1; 53/122, 423, 445, 440, 474

[56] References Cited

U.S. PATENT DOCUMENTS

| | | | |
|---|---|---|---|
| 4,168,002 | 9/1979 | Crosby | 206/459.5 |
| 4,240,552 | 12/1980 | Brown | 206/459.5 |
| 4,397,760 | 8/1983 | Story et al. | 252/370 |
| 4,754,874 | 7/1988 | Haney | 206/77.1 |
| 5,017,302 | 5/1991 | Colwell et al. | 252/134 |
| 5,183,429 | 2/1993 | Bitton | 446/73 |
| 5,240,110 | 8/1993 | Reichenbach, III et al. | 206/459.5 |
| 5,307,934 | 5/1994 | Hagner | 206/461 |
| 5,343,672 | 9/1994 | Kearney et al. | 53/440 |
| 5,486,390 | 1/1996 | Burns et al. | 206/461 |

*Primary Examiner*—James F. Coan
*Assistant Examiner*—Gene L. Kim
*Attorney, Agent, or Firm*—G. Brian Pingel

[57] ABSTRACT

A bar soap including an embedded premium item. A translucent, glycerin soap is cast in a plastic blister package which is pre-loaded with a selected, premium item. During container filling, the soap is cast to embed the premium item within the soap. A backing card containing text and graphics peculiar to the premium item and soap is bonded to the container under heat and pressure with a suitable adhesive. Multiple packages are mounted to a merchandising strip for display and sale.

6 Claims, 4 Drawing Sheets

METHOD OF MOLDING AN PACKAGING OF A NOVELTY SOAP

This application is continuation of application Ser. No. 08/785,120 now abandoned, filed Jan. 21, 1997, which is a Continuation of Ser. No. 08/396,630 now abandoned, filed Mar. 1, 1995.

BACKGROUND OF THE INVENTION

The present invention relates to novelty soaps and, in particular, to a bar soap including a premium item that is cast in place at a mold cavity which forms a portion of the packaging container.

Numerous soaps have been developed which contain a variety of items. Depending upon the intended user and/or consumer, the soap may include any of a variety of novelty or premium items of interest to the consumer. Many soaps intended for children particularly include toys. Examples of such soaps can be found at U.S. Pat. Nos. 1,827,549; 2,677,913; 3,085,883; 3,165,252; 3,359,206; 3,399,206; 4,861,505; 5,183,429; and 5,316,689.

The construction and packaging of each of the foregoing soaps relies on separate molding and packaging processes. That is, the premium item is typically cast into the soap in a separate molding operation at suitable molding forms shaped to receive and contain the premium item and soap material.

Once cast, the soap is packaged in a suitable wrapper. Most frequently, a paper wrapper is folded and bound about the soap. Suitable graphics and text describing the soap are included on the packaging. The packaging may also be transparent to permit the consumer to view the soap before purchase. The soap of the U.S. Pat. No. 5,316,689 is packaged in a multi-section container that also serves as a storage container between usage.

Because such soaps are typically sold with relatively small profit margins, it is desirable to reduce processing and handling to a minimum. The present packaging process was therefore developed to cast a soap directly into a packaging container and which container, in turn, is affixed to a backing piece or card containing appropriate text and graphics to describe the product and also attract consumer interest. Premium items of consumer interest are suitably added to the container prior to or during the pouring of the soap material.

SUMMARY OF THE INVENTION

It is accordingly a primary object of the invention to provide a method for casting a soap within a preferred packaging container and which container is adapted to be affixed to an appropriate backing piece.

It is a further object of the invention to cast the soap into a transparent plastic container or so-called "blister pack or shell" of a desired shape, prior to affixing the blister pack to a card stock, backing piece containing appropriate text and graphics and coated over with an adhesive.

It is a further object of the invention to cast a novelty or premium item, such as a toy, with the soap in a continuous or multiple homogenous pours to embed the toy within the soap.

It is a further object of the invention to cast a buoyant toy within a glycerin based soap at a 0.020 inch thick, thermal formed, transparent, polyvinyl chloride (PVC) plastic container at a molding temperature on the order of 150–200 degrees Fahrenheit.

It is a further object of the invention to bond the container to a card stock material coated over with a printers varnish and a water based soluol adhesive.

Various of the foregoing objects, advantages and distinctions of the invention are obtained in a presently preferred forming and packaging method which comprises the steps of: 1) filling a transparent PVC plastic blister pack of a preferred shape with a premium item of consumer interest; 2) dispensing a glycerin based soap heated to a temperature on the order of 150–200 degrees into the blister pack during a single pour or multiple pouring steps with an intermediate partial cooling; 3) supporting the filled shell to a packaging platen and engaging a blister card pre-printed with appropriate text and graphics and coated over or laminated with a PVC compatible adhesive to the blister pack and card under a pressure in the range of 50–100 PSI at a temperature in the range of 300–350 degrees Fahrenheit.

Still other objects, advantages and distinctions of the invention will become more apparent from the following description with respect to the appended drawings. As various modifications and improvements have been considered, they are described as appropriate. The description should not be literally construed in limitation of the invention. Rather, the invention should be interpreted within the scope and breadth of the further appended claims.

DESCRIPTION OF THE PREFERRED EMBODIMENT

Figure 1:
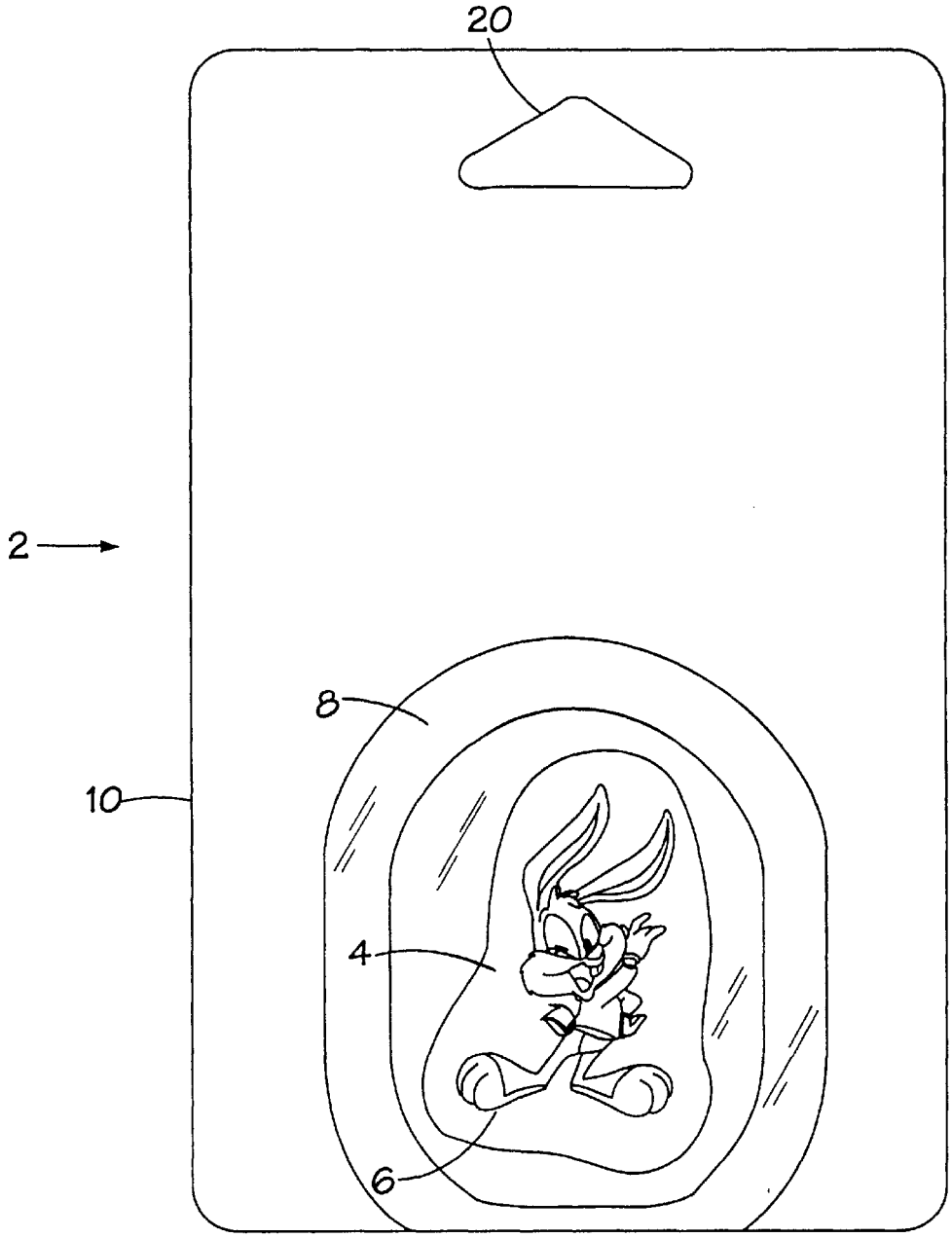
FIG. 1 is a perspective drawing to a packaged bar soap of the invention and wherein a contained premium item is shown in a cutaway through the soap.

Referring to FIG. 1, a package 2 is shown to a bar of novelty soap 4. The soap 4 includes a premium item 6, which shown in a cutaway through the soap 4. The premium item can comprise, a child's toy, coin, figurine, insect, milk cap or any other utilitarian or novelty item easily recognized by a consumer, and which item 6 is preferrably visible through the translucent soap 4. With use and normal dissolution of the soap 4, the item 6 is eventually exposed and available to the user.

The soap 4 is packaged in a transparent plastic shell 8, which is bonded to a backing card 10. The shell 8 is constructed of a nominal 0.020 inch thick polyvinyl chloride (PVC) material. A variety of other sheet good materials at suitable thicknesses, including PETG, HDPE, HMWPE and polypropylene, may also be used to form the shell 8.

Figure 3:
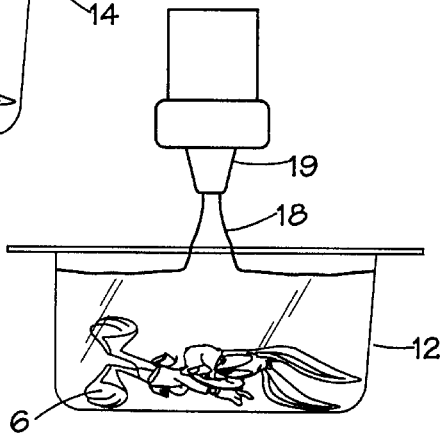
Figure 4:
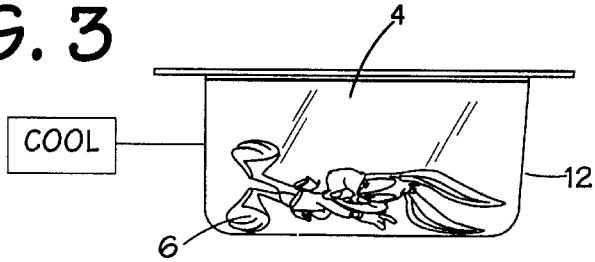

The shell 8 is thermoformed in conventional fashion to provide a cavity 12 of a desired shape and depth, reference FIG. 3. A bonding flange 14 extends from the periphery of the shell 8 and provides a surface 16 which is adhesively bonded to the backing card 10. Presently, the shell 8 is molded to rectilinear and ellipsoidal shapes which are preferred for the soap bar 4.

Blister packs of a variety of other shapes may be used. A particular shape may complement a marketing theme used to present the soap 4 or contained item 6. The shell 8 is presently sized to contain a soap bar 4 of a nominal 2.5 ounce net weight, but again may be adjusted to accomodate a variety of bar weights and sizes. The shell 8 may be positioned anywhere of the surface of the backing card 10 as desired in relation to further contained text and graphics and/or to accommodate further packaging.

With attention to FIGS. 2 through 6, a presently preferred method is described with respect to a buoyant premium toy 6 which is cast into the soap 4 during a molding process which uses the shell 8 as the mold for the soap 4. Conventional processes use a separate mold, which necessitates extracting the soap from the casting mold, removing any flashing, and mounting the soap bar to a packaging container.

Figure 2:
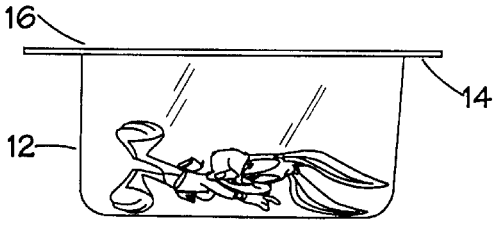
FIGS. 2 through 5 show a diagrammatic sequence of one preferred molding and packaging method used to construct the packaged soap.

First the toy 6 is positioned within an empty shell 8, reference FIG. 2. The toy 6 can be selected from any of a variety of premium items which might catch the fancy of an intended consumer. Toys 6 are preferred for children. A variety of other novelty items, however, can be substituted that appeal to any desired consumer. It is also to be appreciated the advantages of the molding and packaging process of the soap 4 may also be obtained without including a premium item 6 within the soap 4.

The toys 6 are formed from an injection molded plastic having a melt temperature substantially greater than a soap material 18 to assure the soap material 18 does not damage the toy 6. The toys 6 are solid but may be hollow. The depicted rabbit 6 is slightly buoyant in the material 18 and suspends within the soap 4.

Figure 6:
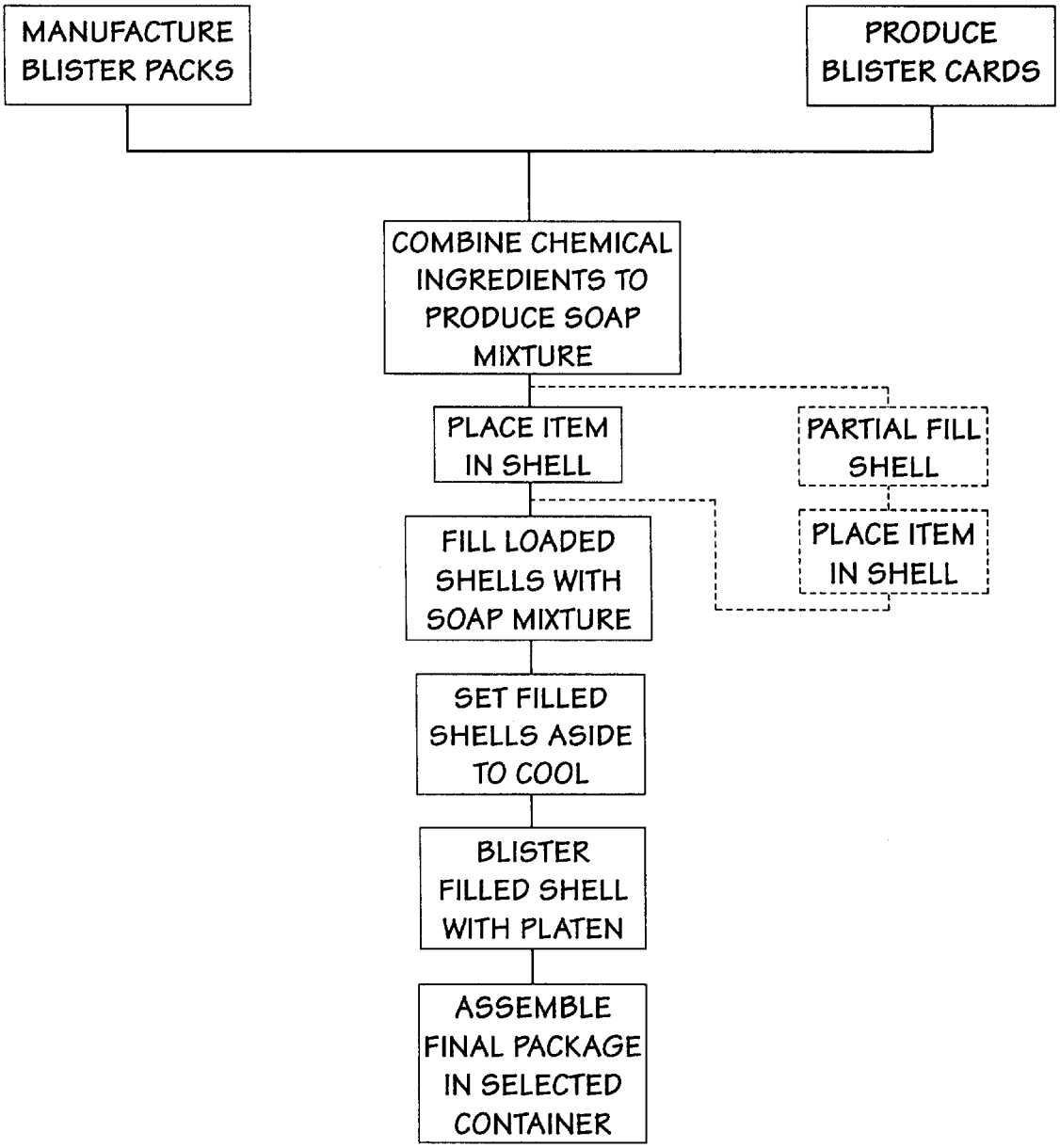
FIG. 6 is a flow chart to the construction method.

A heated liquid soap material 18 is next dispensed into the shell 12 with suitable dispensing equipment 19 in a continuous or an interrupted pour, reference FIGS. 3 and 6. An interrupted pour is shown in dashed line at FIG. 6.

As the soap material 18 is added, the toy 6, which has a specific gravity less than the material 18, tends to float the toy 6 in the material 18. With the filling of the shell 8, the shell 8 is cooled to induce a quick or a partial setting of the material 18 to trap the toy 6 within the soap 4 without being exposed through the soap 4, reference FIG. 4. Final or finish curing of the soap 4 can occur in a controlled temperature environment.

As shown in dashed line at FIG. 6, the material 18 can also be poured in an interrupted pour. During such a process, a partial quantity of soap material 18 is added to the shell 8 and partially set. A premium item 6 is added during a delay before a final pour step. The item 6 thereby becomes partially contained by the material 18 before the final pour fills the shell 8 to final depth. For the depicted toy 6, a continuous pour is preferred.

The material 18 used in the soap 4 comprises a glycerine based formula. A presently preferred ingredient composition, which yields approximately 4100 2.5 ounce bars of soap 4, is:

123.5 lbs TEA lauryl sulfate
70.9 lbs icromonetant LAMEA
137.2 lbs Incromide CAC
95.4 lbs Glycerine 99% USP
64.7 lbs Propylene glycol
7.6 lbs perfume
1.3 lbs TCC
1 lb NaEDTA
150 lbs Sodium Stearate Colorant, as desired The ingredients are heated to a temperature in the range of 150 to 200 degrees Fahrenheit and blended until a homogenous liquid is obtained. Impurities and any suds are skimmed as necessary. A pour temperature of 180 degrees Fahrenheit is preferred. Although one ingredient listing is provided, it is to be appreciated a variety of other ingredients and mixtures in varying concentrations may be used.

The material 18 is preferably dispensed to a depth slightly below the flange 14 and not to contaminate the surface 16. A variety of conventional dispensing equipment can be used to this end. The surface 16 may also be masked with a cover or sprayed with a masking material to prevent any of the material 18 from accumulating onto the surface 16. Any spillage can affect the setting of the packaging adhesive.

Once poured, the material 18 is allowed to cool for approximately eight hours at room temperature. Alternatively, the shells 8 can be directed through a curing tunnel at a controlled temperature gradient to reduce the cooling time. Fans or other appliances may also be used to facilitate cooling over a shorter period. Preferably, the soap 4 should cool without cracking or checking, especially at the outer surfaces, which detracts from the perceived quality of the soap and the ability of the consumer to observe the item 6.

Figure 5:
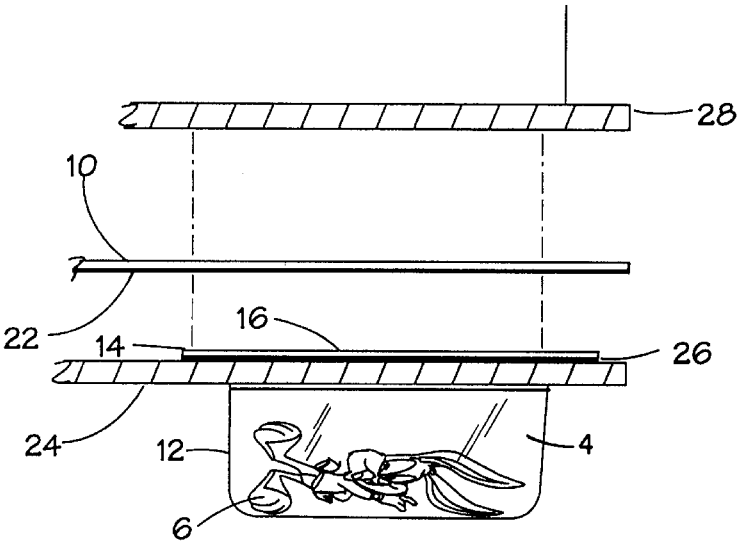

Referring to FIG. 5 and once cooled, the filled shell 8 is bonded to a backing card 10. The card 10 is die cut from a 24 wt. CIS MASTERSEAL board material to a preferred shape. An aperture 20 is provided to facilitate displaying the package 2 at shelf pegs or in a presently preferred strip pack 30 containing a number of easily removed packages 2. Any suitable weight card stock cut to any of a variety of desired shapes can be substituted.

The card 10 is printed in one or more colors with any desired graphics to attract consumer attention and may include necessary text identifying ingredients, explaining use, safety warnings etc. The printed matter is covered over with a conventional printer's varnish, which is resistant to the glycerine soap material 18 and a further applied coating of an adhesive 22.

The adhesive 22 is selected to be compatible to the backing card 10 and shell 8. The adhesive is coated to at least the surface regions of the card 10 which contact the flange 14. Presently a Soluol 1051-225, waterbase blister coat material is used as the adhesive. A variety of other adhesives compatible with blister packs made from the above noted materials may be used.

The cooled bar soap 4 and shell 8 are next mounted to a sealing platen 24. The shell 8 is mounted within an aperture 25 and the flange 14 is supported at a rubber gasket or conformal surface 26. The printed card 10 is aligned to the shell 8 and a heated platten 28 is brought to bear against the back of the card 10 at a sufficient pressure and temperature and for a sufficient duration to bond the card 10 to the shell 8. The platen 28 is presently heated to a temperature in the range of 325 to 350 degrees Fahrenheit and pressed to the card 10 and platten 24 at a pressure in the range of 70 to 80 psi for approximately 3 to 4 seconds. Sufficient thermal heat is transferred through the card 10 to melt the adhesive 22 and bond the card 10 to the shell 8.

Figure 7:
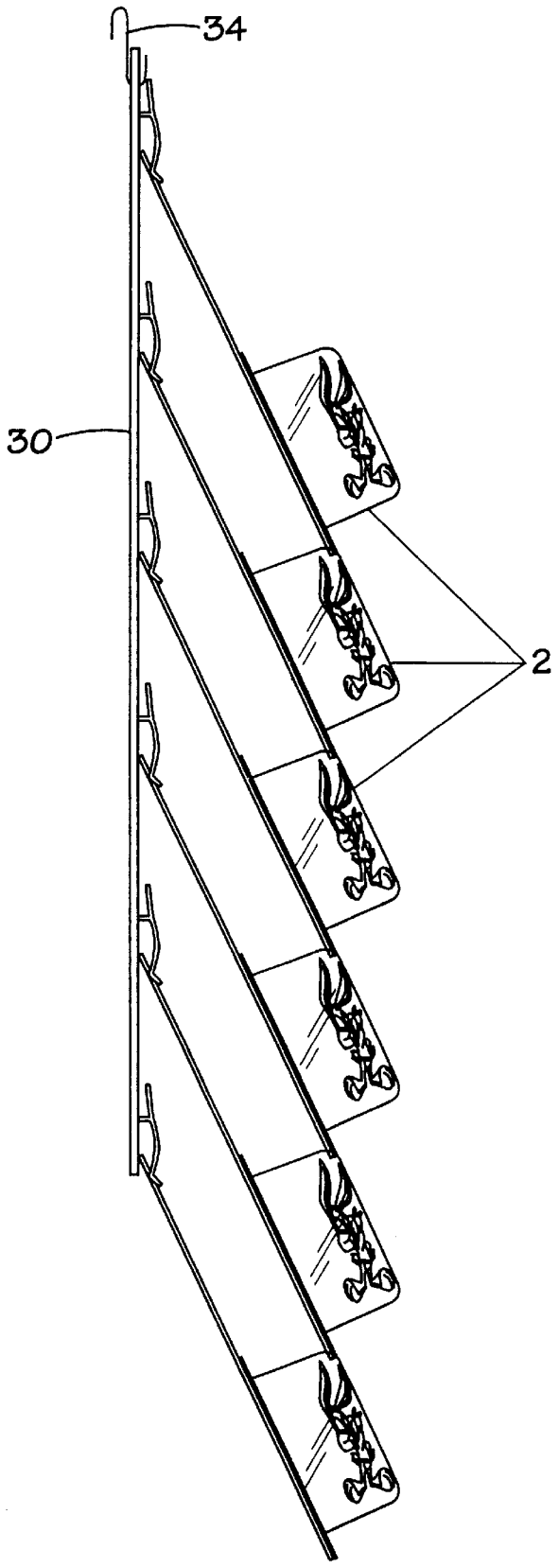
FIG. 7 shows a number of soap packages mounted to a merchandising strip support.
Figure 8:
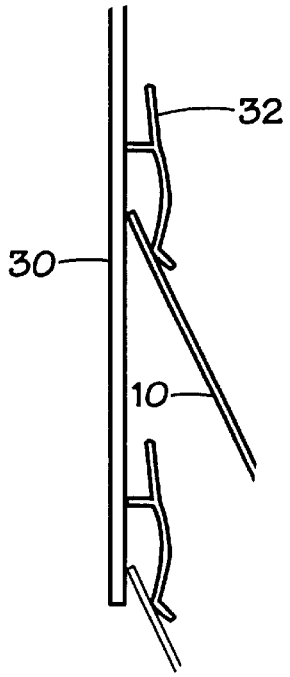
FIG. 8 shows a detailed view of the mounting of a clip at the merchandising strip to the soap backing card.

Final packaging occurs with a number of packages 2 being subsequently mounted to a merchandising strip support 30, reference FIGS. 7 and 8. A number of resilient appendages or spring biased clips 32 project from the strip support 30 to fasten to the packages 2 and permit the extraction of the packages from the strip support 30. The strip support 30 is typically displayed from a hook 34 at a store location convenient to the consumer, such as for impulse purchase.

While the invention has been described with respect to a presently preferred construction and various considered modifications and improvements thereto, still other constructions and methods may be suggested to those skilled in the art. The invention should therefore be construed within the spirit and scope of the following claims.

What is claimed is:

1. A method of manufacturing and packaging a bar soap comprising:

(a) molding a plastic container from a material having a first melt temperature;

(b) wherein said plastic container is substantially transparent;

(c) providing a premium item having a second melt temperature;

(d) wherein said premium item is at least partially opaque;

(e) positioning said premium item within said plastic container;

(f) providing soap having a third melt temperature;

(g) wherein said third melt temperature is less than said first melt temperature;

(h) wherein said third melt temperature is less than said second melt temperature;

(i) wherein said soap is substantially transparent;

(j) melting said soap;

(k) adding said soap to said plastic container in a manner which positions said premium item at least partially within said soap;

(l) cooling said soap;

(m) providing a backing card with text applied thereto; and (n) bonding said backing card to said plastic container.

2. The method as set forth in claim 1, wherein said plastic container exhibits a shape complimentary to said premium item.

3. The method as set forth in claim 1, wherein said premium item is a toy.

4. The method as set forth in claim 1, wherein said soap contains less than ten percent water.

5. The method as set forth in claim 1, wherein said soap contains substantially no water.

6. The method as set forth in claim 1, wherein said backing card is substantially impermeable to moisture.

* * * * *